US005855026A

United States Patent [19]

Viola

[11] Patent Number: 5,855,026

[45] Date of Patent: Jan. 5, 1999

[54] INTEGRATED SWIM CAP AND GOGGLES

[76] Inventor: Barry J. Viola, Rte. 4, Box 60A, Arkansas City, Kans. 67005

[21] Appl. No.: 895,013

[22] Filed: Jul. 16, 1997

[51] Int. Cl.[6] ..... A61F 9/02; A42B 1/12

[52] U.S. Cl. ..... 2/428; 2/68

[58] Field of Search ..... 2/428, 429, 430, 2/68, 452, 209.13, 426

[56] References Cited

U.S. PATENT DOCUMENTS

| | | | |
|---|---|---|---|
| 2,568,316 | 9/1951 | Brown | 2/428 |
| 2,581,007 | 1/1952 | Douglas | 2/68 X |
| 2,705,802 | 4/1955 | Tellier | 2/68 |
| 4,724,550 | 2/1988 | Fox et al. | 2/68 X |
| 5,560,047 | 10/1996 | Shimada | 2/68 X |

*Primary Examiner*—Peter Nerbun

*Attorney, Agent, or Firm*—Shook, Hardy & Bacon L.L.P.

[57] ABSTRACT

A headwear apparatus for use in swimming is provided that has a generally hemispherically shaped swim cap portion with a forward section and a rearward section. The forward section has a forward terminal edge which is coupled to a goggle portion along the forward terminal edge. The goggle portion includes a left lens and a right lens that each have a front surface and an outer perimeter surface extending rearwardly from the front surface. The outer perimeter surface has an upper portion that is coupled to the forward terminal edge of the swim cap portion. The swim cap portion has a thickness defined by a top surface and a bottom surface, and the top surface of the forward section is in a planar relationship with the front surface of the lenses at the forward terminal edge. The swim cap portion has a rearwardly extending strap formed integrally with the cap portion.

8 Claims, 1 Drawing Sheet

INTEGRATED SWIM CAP AND GOGGLES

FIELD OF THE INVENTION

This invention relates to headwear for use in swimming, and more particularly to a one-piece swim cap and goggles that can be used for competitive swimming events.

BACKGROUND OF THE INVENTION

Competitive swimming was included in the first modern Olympic Games in 1896 and has since continued as a competitive sport. Today competitive swimming events include not only the traditional races held in swimming pools, but also races in open water, such as the swimming legs of triathlons. In almost all modem competitive swimming events, the swimmer will wear conventional swimming goggles, such as those shown in FIG. 1 designated by numeral 110. Goggles are used to increase the swimmer's vision under water and to shield the swimmer's eyes from contaminants such as salt in the ocean, or chlorine in a swimming pool. The prior art goggles currently in use have a pair of lenses 112 which are coupled together by a nose bridge 114. The outer perimeter of the lenses is typically surrounded by a foam rubber padding ring which acts as a sealing material. This foam padding ring is placed against the eye-socket area of the swimmer. Extending rearwardly from the outside edges of the lenses is an elastic strap 116 which is placed around the swimmer's head to exert a force on the foam padding rings so that water is prevented from flowing into the spaces between the lenses and the swimmer's eyes.

The swimming goggles currently in use, however, suffer from several disadvantages. First, the swimming goggles leak when in use. This leakage allows water and contaminants to enter the spaces between the lenses and the swimmer's eyes. At some point during the competition, the swimmer may experience discomfort or impaired vision due to the water which has entered these spaces. Enough water may leak into these spaces to cause the swimmer to empty the goggles and reseal the lenses against the swimmer's face. This is disadvantageous in a competition because time is spent away from advancing towards the finish line.

Different materials have been employed for the padding rings of conventional goggles in an attempt to form a better seal between the lenses and the swimmer's face. These materials have improved the performance somewhat, but leakage problems remain. It has been found that the major point of leakage is along the upper margins of the padding rings. As best seen in FIG. 1, the prior art goggle lenses protrude outwardly from the swimmer's face. As the swimmer propels himself forwardly through the water, the protruding section of the lenses causes a turbulent flow of water around the lenses. This turbulence can exert forces on the goggles sufficient to cause the upper portions of the goggle lenses to rotate away from the swimmer's face. If the lenses so rotate, the seal between the padding rings and the swimmer's face will be at least partially broken, thus allowing water to leak into the areas between the lenses and the swimmer's face Another method of discouraging leakage is to increase the force applied to the lenses with the elastic strap, in an attempt to overcome the forces caused by the turbulence discussed above. The force necessary to do so can result in discomfort to the swimmer as the goggles are forced inwardly against the eye and eye socket. Thus, developments in padding ring materials and elastic strap designs have not completely solved the problem of leakage.

Another disadvantage of prior art goggles is the increased drag caused by the protruding lenses of the goggles as the swimmer propels himself through the water. In competitive swimming events, every effort is made to reduce the drag caused by the swimmer and his equipment. Reduced drag results in improved hydrodynamics and can result in lower times to complete the event. Therefore, the protruding goggle lenses not only cause potential leakage problems, but also cause the swimmer to experience increased resistance as he travels through the water.

Also worn by the competitive swimmer is a swimming cap represented in FIG. 1 by the numeral 118. Conventional swimming caps are worn over the head of the swimmer and are used to increase the hydrodynamics of the swimmer by containing the swimmer's hair, thus reducing the drag caused by the swimmer's head and hair. Swimming caps are also used by swimmers in open water to alert others to the swimmer's presence. The swimming caps are brightly colored for use in this fashion. Currently, a swimming cap is needed in addition to the swimming goggles. This necessitates first putting the swimming cap on, and then putting the swimming goggles on. This also necessitates having to keep track of two pieces of swimming headwear.

Therefore, a piece of swimming headwear is needed that will reliably prevent leakage around the lenses of swimming goggles. Further, a piece of swimming headwear is needed that will improve the hydrodynamics of the swimmer in the water by reducing the drag caused by the headwear. Finally, a piece of swimming headwear is needed that combines the typical swimming goggles and the swimming cap into a single unit.

SUMMARY OF THE INVENTION

It is therefore an object of the present invention to provide a piece of swimming headwear that prevents leakage around the lenses of the headwear.

It is a further object of the invention to provide a piece of swimming headwear that improves the hydrodynamics of the swimmer.

It is yet another object of the invention to provide a piece of swimming headwear that combines the swimming cap and the swimming goggles into a single unit.

According to the present invention, the foregoing and other objects are achieved by a headwear apparatus for use in swimming that has a generally hemispherically shaped swim cap portion with a forward section and a rearward section. The forward section has a forward terminal edge which is coupled to a goggle portion. The goggle portion includes a left lens and a right lens that each have a front surface and an outer perimeter surface extending rearwardly from the front surface. The outer perimeter surface has an upper portion that is coupled to the forward terminal edge of the swim cap portion. The swim cap portion has a thickness defined by a top surface and a bottom surface, and the top surface of the forward section is in a planar relationship with the front surface of the lenses at the forward terminal edge. The swim cap portion also preferably has a rearwardly extending strap formed integrally with the cap portion.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENTS

Figure 1:
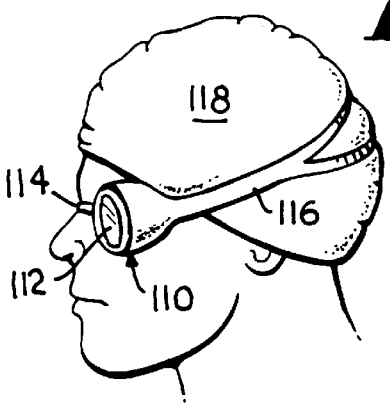
FIG. 1 is a perspective view of a prior art device in use on a swimmer's head.
Figure 2:
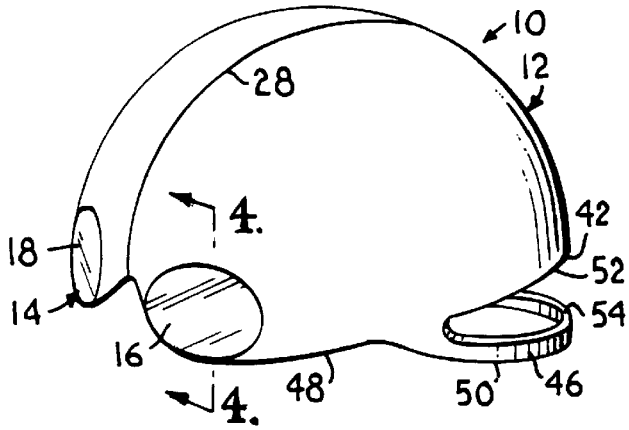
PRIOR ART Fig. 2.
FIG. 2 is a perspective view of the swimming headwear apparatus according to a preferred embodiment of the present invention.
Figure 3:
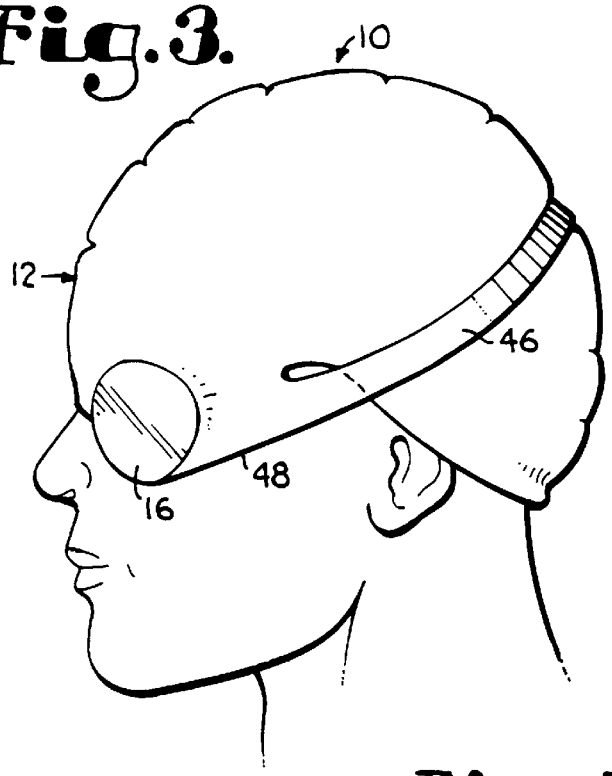
FIG. 3 is a perspective view of the headwear apparatus of FIG. 2, shown as worn on a swimmer's head.
Figure 4:
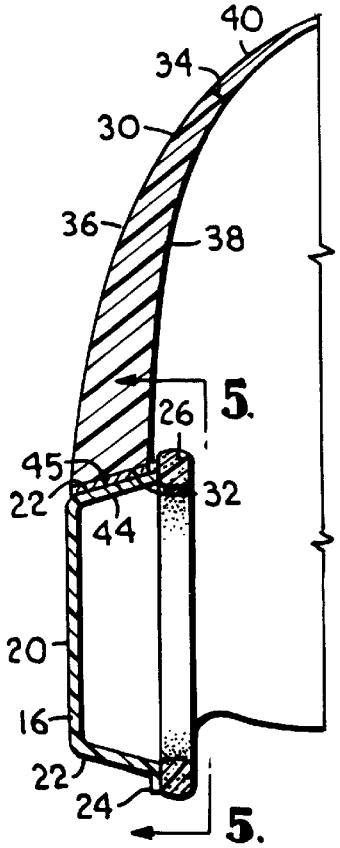
FIG. 4 is a partial sectional view of the headwear apparatus of FIG. 2, taken along line 4—4 of FIG. 2.
Figure 5:
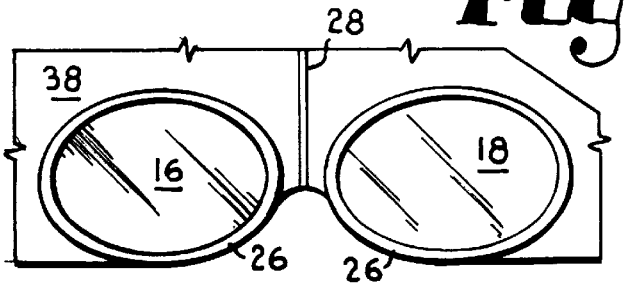
FIG. 5 is a partial sectional view of the headwear apparatus of FIG. 2, taken along line 5—5 of FIG. 4.

Referring now to the drawings in detail and initially to FIG. 2, a piece of swimming headwear according to a preferred embodiment of the present invention is represented broadly by the numeral 10. Headwear 10 has a swim cap portion 12 and a goggle portion 14. Goggle portion 14 includes a left lens 16 and a right lens 18 which are designed to enhance the vision of the swimmer. As best seen in FIG. 4, lenses 16 and 18 each have a front surface 20 and a rearwardly extending outer perimeter surface 22, and are typically made of a molded plastic material, as is well known in the art. Perimeter surface 22 terminates to form an outer rim 24, which is coupled to a generally ovular padding ring 26.

Ring 26 is typically made from a foam rubber material and acts to enhance the comfort of the wearer as well as acting as a sealing material, as further described below. Ring 26 cooperates with front surface 20 and perimeter surface 22 of lenses 16 and 18 to form an enclosed volume when ring 26 is placed against the swimmer's face. Front surface 20 and perimeter surface 22 can be shaped somewhat arcuately to filter reduce the drag caused by goggle portion 14. Lenses 16 and 18 may be coupled together with a nose bridge (not shown) as is known to those in the art, but are preferably properly held in spaced relation by swim cap portion 12, as is more fully described below.

Swim cap portion 12 is generally hemispherically shaped to roughly model the shape of the top of a human head and is made of a material, such a latex rubber, that can be tightly, but comfortably placed over the head of a swimmer. Swim cap portion 12 may be formed with a seam 28 therein and is sized to extend from approximately the eyebrow area of the swimmer to the back of the swimmer's head, with swim cap portion 12 extending at least partially over the swimmer's ears. More specifically, swim cap portion 12 has a forward section 30 that is defined by a forward terminal edge 32, a transition boundary 34, a top surface 36 and a bottom surface 38. Swim cap portion 12 also has a rearward section 40 that is defined by transition boundary 34, top surface 36, bottom surface 38 and a rearward terminal edge 42. The thickness of rearward section 36 is defined by the distance between top surface 36 and bottom surface 38 and is preferably the thickness of existing swimming caps, as is known to those in the art. Forward section 30 transitions smoothly to rearward section 40 and transition boundary 34 is not noticeable to the eye. Rather, transition boundary 34 delineates the point at which the thickness of swim cap portion 12 begins to increase.

The thickness of forward section 30 is also defined by top surface 36 and bottom surface 38. The thickness of forward section 30 is identical to the thickness of rearward section 40 at transition boundary 34. The thickness of forward section 30 gradually increases from transition boundary 34 to forward terminal edge 32. Swim cap portion 12 is thus thickest at forward edge 32 to allow cap portion 12 to be securely attached to goggle portion 14. More specifically, swim cap portion 12 is attached to an upper portion 44 of outer perimeter surface 22. As best seen in FIG. 4, forward terminal edge 32 is coupled to upper portion 44, such as by an adhesive 45. Forward edge 32 is of sufficient thickness to allow op surface 36 of forward section 30 to be in planar relationship with front surface 20 of lenses 16 and 18, and to properly hold lenses 16 and 18 in spaced relation.

Swim cap portion 12 preferably has formed therein an integral strap 46. As best seen in FIG. 2, forward terminal edge 32 transitions to a front side perimeter 48. Front side perimeter 48 extends rearwardly from lenses 16 and 18 and transitions into lower strap edge 50. Further, rearward terminal edge 42 transitions to a rearward side perimeter 52 that extends forwardly and that transitions to an upper strap edge 54. Strap 46 is thus defined by lower strap edge 50 and upper strap edge 54. Strap 46 is preferably made of the same latex rubber material as is used for the remainder of swim cap portion 12 and is preferably integrally formed in swim cap portion 12. Strap 46 is used for securing the lower portion of goggle portion 14 to the swimmer's head and allows the swimmer to customize the feel and fit of headwear 10.

In use, headwear 10 can be put on by the swimmer with relative ease. Typically the swimmer can stretch swim cap portion 12 outwardly so that it can be placed over the swimmer's head. The swimmer will position goggle portion 14 so that lenses 16 and 18 are directly in front of the swimmer's eyes. Finally, strap 46 is positioned at the rear of the swimmer's head so that goggle portion 14 is comfortably held in place around the swimmer's eyes. Once in place, the swimmer is ready to begin the competitive event. Because top surface 36 of cap portion 12 is co-planar with front surface 20 of lenses 16 and 18, the hydrodynamics of the swimmer is improved, so the drag caused by the swimmer will be reduced. The improved hydrodynamics makes it possible for the swimmer to exert less energy to travel the same distance in a lower time. Further, because top surface 36 of cap portion 12 is co-planar with front surface 20 of lenses 16 and 18, the flow of water over cap portion 12 and goggle portion 14 will be more laminar and less turbulent, reducing the likelihood that goggle portion 14 will rotate away from the swimmer's face. Therefore, headwear 10 is less likely to allow water to enter the space between lenses 16 and 18 and the swimmer's face.

From the foregoing, it will be seen that this invention is one well adapted to obtain all of the ends and objects hereinabove set forth together with other advantages which are obvious and which are inherent to the structure. It will be understood and certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A one piece headwear apparatus for use in swimming, comprising:

a generally hemispherically shaped swim cap portion including a forward section and a rearward section, said forward section having a forward terminal edge;

a goggle portion including a pair of lenses each have a padding ring coupled to an outer perimeter surface thereof; and an adhesive between the lenses and the forward terminal edge for securing the lenses to the swim cap portion.

2. The headwear apparatus of claim 1, wherein said pair of lenses each have a front surface and an outer perimeter surface extending rearwardly from said front surface.

3. The head wear apparatus of claim 2, wherein said outer perimeter surface has an upper portion that is coupled to said forward terminal edge of said swim cap portion by said adhesive.

4. The headwear apparatus of claim 3, wherein said swim cap portion has a thickness defined by a top surface and a bottom surface, and wherein said top surface of said forward section is in a planar relationship with said front surface of said pair of lenses, at said forward terminal edges.

5. The headwear apparatus of claim 4, wherein the thickness of said forward section at said forward terminal edge is greater than the remainder of said swim cap portion.

6. The headwear apparatus of claim 1, wherein said swim cap portion has a strap extending rearwardly from said goggle portion formed integrally therein.

7. A headwear apparatus for use in swimming, comprising:

a generally hemispherically shaped swim cap portion including a forward section having a thickness that gradually increases from an upper portion to a lower portion thereof, said lower portion of said forward section having a forward terminal edge, said swim cap portion further including a rearward section; and a goggle portion coupled to said forward section along said forward terminal edge.

8. A head wear apparatus adapted to be worn by a swimmer wherein said swimmer has a head and a face portion, comprising.

a generally hemispherically shaped swim cap portion including a forward section and a rearward section for placement on the head of the swimmer;

a pair of lenses, each including an outer rim and being coupled to the forward section of the swim cap portion to form a single unit that remains unitary when removed from the head of the swimmer; and a padding ring secured to the outer rim of each of the lenses, the padding rings and lenses being adapted to form an enclosed volume against the face of the swimmer.

* * * * *